US005661862A

United States Patent [19]

Ryndak

[11] Patent Number: 5,661,862

[45] Date of Patent: Sep. 2, 1997

[54] MULTITIERED PILLOW CONSTRUCTION

[76] Inventor: James D. Ryndak, 3 Hickory La., Barrington Hills, Ill. 60010

[21] Appl. No.: 687,047

[22] Filed: Jul. 25, 1996

[51] Int. Cl.[6] ..... A47G 9/00

[52] U.S. Cl. ..... 5/636; 5/644; 5/645

[58] Field of Search ..... 5/636, 640, 644, 5/645, 952, 953

[56] References Cited

U.S. PATENT DOCUMENTS

| | | | |
|---|---|---|---|
| 247,892 | 10/1881 | Doremus . | |
| 395,043 | 12/1888 | Doremus . | |
| 1,020,444 | 3/1912 | Platt | 5/645 |
| 1,385,355 | 7/1921 | Banks | 5/636 |
| 1,701,124 | 2/1929 | Safford . | |
| 2,500,974 | 3/1950 | Angert | 5/645 |
| 2,589,303 | 3/1952 | Sourbeck | 5/645 |
| 2,700,779 | 2/1955 | Tolkowsky . | |
| 2,720,660 | 10/1955 | Smith . | |
| 3,243,828 | 4/1966 | McCarty . | |
| 3,521,310 | 7/1970 | Greenawalt | 5/636 |
| 3,694,831 | 10/1972 | Treace . | |
| 3,849,810 | 11/1974 | Degen . | |
| 4,513,462 | 4/1985 | Thomas . | |
| 4,754,513 | 7/1988 | Rinz . | |
| 4,908,894 | 3/1990 | Sanders . | |
| 5,168,590 | 12/1992 | O'Sullivan . | |
| 5,271,114 | 12/1993 | Kjersem . | |
| 5,471,691 | 12/1995 | Ryndak | 5/636 X |

FOREIGN PATENT DOCUMENTS

| | | |
|---|---|---|
| 2009792 | 11/1970 | Germany . |

*Primary Examiner*—Michael F. Trettel
*Attorney, Agent, or Firm*—Jenner & Block

[57] ABSTRACT

A multitiered pillow is provided that is especially adapted for supporting the head of a person while sleeping. At least two tiers of different height are provided by the pillow to accommodate and properly support a person's head and neck regardless of whether the person is sleeping on his side (shoulders vertical) or prostrate (shoulders horizontal).

12 Claims, 4 Drawing Sheets

MULTITIERED PILLOW CONSTRUCTION

FIELD OF THE INVENTION

The present invention relates to pillow constructions. More particularly, the present invention relates to having different effective thicknesses to accommodate a person's head and provides proper support for the head and neck for a person's vertical and horizontal sleeping positions.

BACKGROUND OF THE INVENTION

When sleeping, a person commonly uses a pillow for supporting the head and neck areas. The thickness of the pillow required for proper support varies from person to person because of shoulder width, head and neck size and weight. Moreover, the required thickness and support of a pillow depends on how the person is oriented when sleeping, such as whether a person's shoulders are horizontal or vertical. In the horizontal shoulder position, less support is required than in the vertical shoulder position because of the varying distance between the portion of the head adjacent the bed surface depending on the position of the shoulders.

Failure to provide the proper support of the head and neck while sleeping can result in a stiff neck and/or shoulders.

Some persons commonly sleep with two pillows laid on top of each other to increase the height of support that is provided. Such increased height may generally provide the proper support when the person's shoulders are in the vertical position, since the person's head is further away from the surface of the bed. However, when the person is in the horizontal shoulder position (prostrate), the pillow support surface is too high for the support height that is required. Thus, utilizing two stacked pillows also fails to provide proper sleeping positions when laying flat and prostrate.

A need exists for a pillow that provides optimum head and neck support regardless of a person's horizontal or vertical shoulder orientation while sleeping.

SUMMARY OF THE INVENTION

In accordance with the present invention, a pillow construction especially adapted for sleeping is provided that allows for optimum head and neck support of a sleeping person regardless of whether the person's shoulders are oriented in a vertical or horizontal position. Thus, a person's head is oriented with respect to the shoulders in a position similar to when a person is standing erect, regardless of whether the sleeping person is on his side (shoulders vertical to the bed surface) or prostrate (shoulders horizontal to the bed surface).

The pillow in accordance with the present invention is a multitiered pillow, preferably having at least two tiers, each tier being of a generally uniform height. Preferably, the tiers comprise lower and upper tiers with the upper tier having an actual thickness or an effective height of approximately two to three times the thickness or effective height of the first or lower tier. "Effective height" as used herein means the pillow height at a location of the pillow that is subjected to a compressive force such as the force created when a person's head is lying on that location of the pillow.

The upper and lower tiers thus provide optimum sleeping support positions for the head and neck regardless of whether the sleeping person is laying down with the shoulders in a horizontal or vertical position. In accordance with one embodiment, a multitiered pillow is provided that is composed of an elongated compressible pillow body having a width and a depth, the pillow body defining a pillow top and a pillow bottom and at least first and second tiers, the second tier having an uncompressed height from the pillow bottom of at least about twice the uncompressed height from the pillow bottom of the first tier, the height of the first tier being suitable for supporting a person's head while in a prostrate position and the height of the second tier being suitable for supporting a person's head while laying on the side. In accordance with another embodiment, the uncompressed height of each of the tiers is the same or essentially the same, the second tier having an effective height of about two to three times the effective height of the first tier.

The elongated pillow body may be composed of a unitary mass of compressible material, such as foam rubber or other suitably compressible resilient material. Regions may have different compressibility so as to provide tiers of the same or essentially the same uncompressed height having desired effective (compressed) heights (e.g., one tier having an effective height of about two to three times the effective height of the other tier). Alternatively, the pillow body may be composed of a plurality of compartments that contain a pillow packing material, such as goose down or other suitable packing material. Preferably, the compartments are segregated from each other and each compartment is associated with only an upper tier or a lower tier for maintaining the proper relative tier height or effective height differential.

In one embodiment, the first and second tiers are each composed of a substantially flat plateau portion relative to the pillow bottom. The second or higher tier may further include a portion of decreasing height that extends from the substantially flat plateau portion of that tier. Also, the longitudinal pillow thickness may decrease along at least one of the longitudinal pillow ends. Preferably, the pillow bottom curves upwardly at the longitudinal end of decreasing thickness and is adjacent the portion of the second tier of decreasing height.

In accordance with another embodiment, the longitudinal cross section of the pillow body is U-shaped and includes two upper tiers separated by a lower tier.

In accordance with another embodiment, the pillow body defines a central upper tier (or greater effective height) and adjacent lower tiers (or tiers of lower effective height) on either longitudinal pillow side of the central upper tier.

In accordance with still another embodiment, the pillow body defines an upper tier (or tier of greater effective height) on one longitudinal side of the pillow body and a lower tier (or tier of lower effective height) on the other longitudinal side of the pillow body.

DETAILED DESCRIPTION

Figure 1:
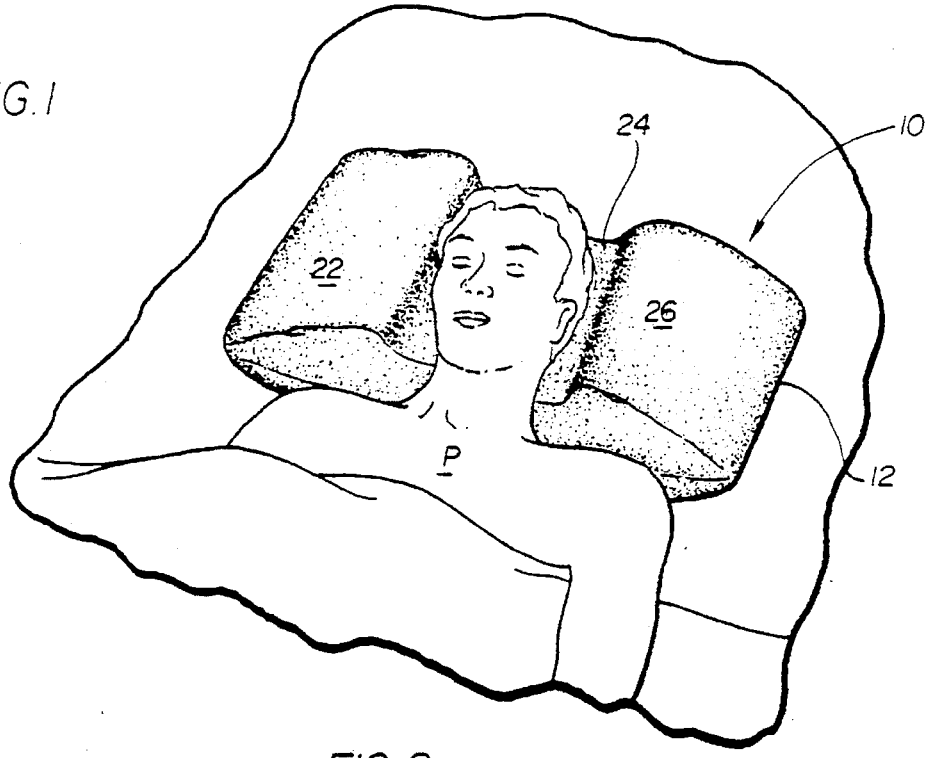
FIG. 1 illustrates in perspective view a pillow in accordance with the invention being utilized by a sleeping person.
Figure 2:
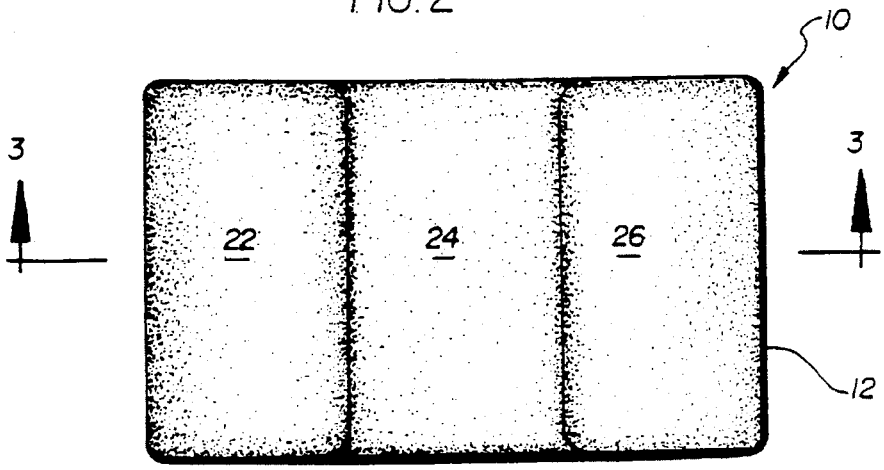
FIG. 2 illustrates a top plan view of the pillow of FIG. 1.
Figure 3:
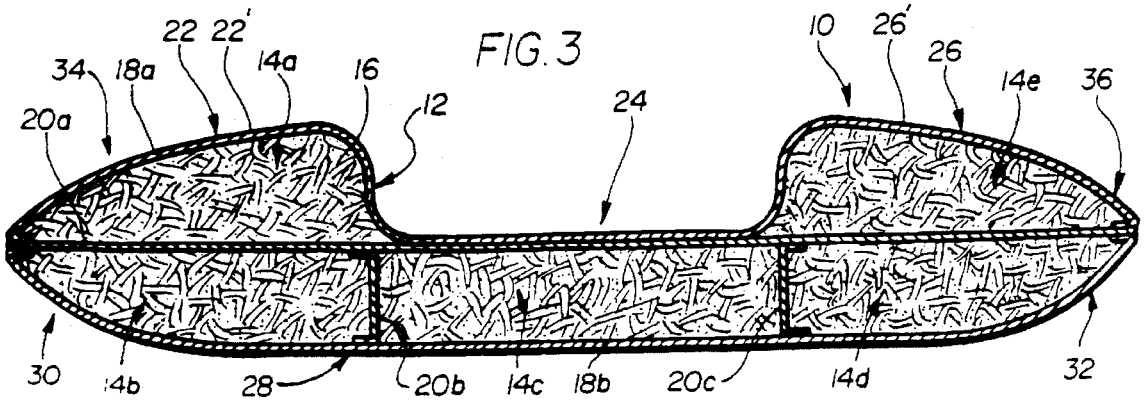
FIG. 3 illustrates a cross-sectional elevation view of the pillow of FIG. 2 along lines 3—3 of FIG. 2.

Referring to the Figures generally and in particular to FIGS. 1–3, there is illustrated a multitiered pillow 10 in accordance with the present invention. Multitiered pillow 10 defines an elongated pillow body. In the illustrated embodiment, multitiered pillow 10 is composed of a shell 12 defining a plurality of segregated compartments 14*a–e* extending the transverse width of pillow 10 for containing pillow packing material 16. Shell 12 is composed of outer panels 18*a–b* which defines the outer limits of multitiered pillow 10. Shell 12 is also composed of inner panels 20*a–c*. Inner panels 20*a–c* serve to segregate shell 12 into segregated compartments 14*a–e*. Typically, outer panels 18*a–b* and inner panels 20*a–c* can be any suitable fabric for pillow 10, such as cloth, for example, and can be fastened together by any suitable structure, such as by sewing, or adhesive, for example.

As illustrated in FIG. 3, shell 12 in combination with pillow packing material 16 defines a plurality of tiers, in this case an upper tier 22, a lower tier 24 and an upper tier 26, each extending across the transverse width of pillow 10.

Upper tiers 22 and 26 are of a suitable height for supporting a person's head and neck when the person is sleeping on his side and lower tier 24 is of a suitable height for supporting a person's head and neck when the person is sleeping in a prostrate position, such as person P in FIG. 1. Each of upper and lower tiers 22, 24 and 26 define a relatively flat plateau portion relative to bottom 28 of pillow 10. Bottom 28 of pillow 10 includes longitudinal ends 30 and 32 of decreasing thickness, as shown in FIG. 3. Longitudinal ends 30 and 32 are adjacent with the portion of upper tiers 22 and 26 that decrease in height from the substantially flat plateau portion of tiers 22 and 26 towards the longitudinal ends of pillow 10. As a result, the longitudinal ends of pillow 10 provide an area of decreased thickness thereby providing a lower surface than the substantially flat plateau portions 22' and 26' of tiers 22 and 26. Thus, the longitudinal ends 34 and 36 of pillow 10 provide areas of decreased thickness yet are thicker and higher than lower tier 24, thereby providing an especially suitable height for supporting the head and neck of a person laying in between the prostrate and side positions.

Because segregated compartments 14*a–e* are each associated either with an upper tier (22 or 26) or a lower tier (24) and such compartments extend transversely of pillow 10 as do tiers 22–26, packing material 16 in a particular compartment 14*a–e* remains associated with that compartment thereby maintaining the integrity and shape of tiers 22–26.

Figure 6:
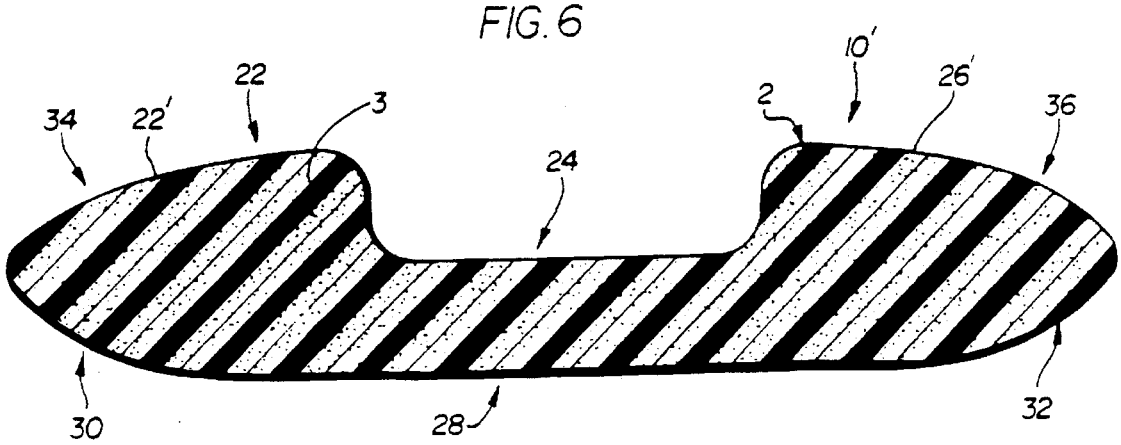
FIG. 6 illustrates a cross-sectional view of another pillow in accordance with the present invention.

Alternatively, multitiered pillow 10 could be constructed of a unitary mass of compressible material, such as foam rubber or other suitable material. Multitiered pillow 10' of FIG. 6 illustrates such an embodiment in which pillow 10' is constructed of a unitary mass 38 of foam rubber formed in a desired shape which is illustrated in FIGS. 1, 2 and 6. In the embodiment illustrated in FIG. 6, like reference numerals illustrate like shape, structure and surface contours as set forth in FIG. 3.

Figure 4:
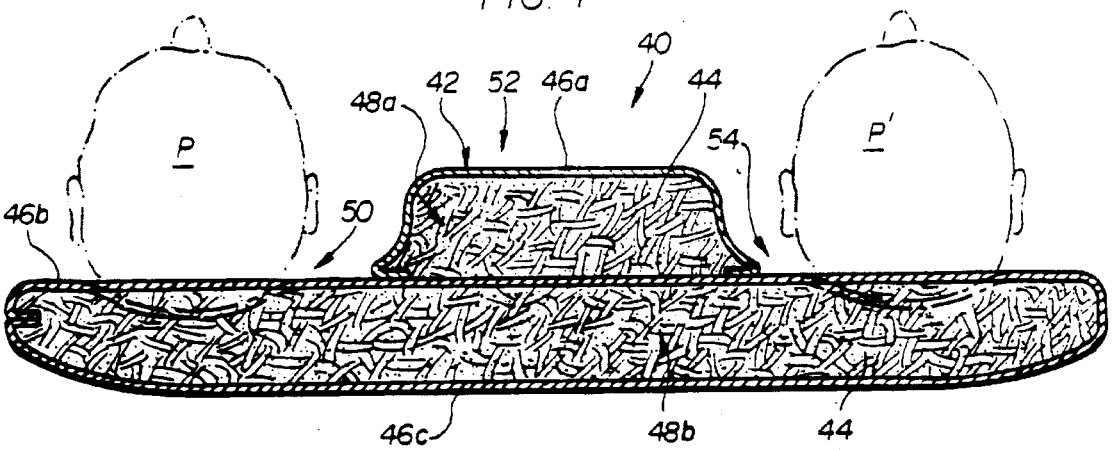
FIG. 4 illustrates a cross-sectional view of another pillow in accordance with the present invention.

Referring to FIG. 4, there is illustrated another multitiered pillow 40 in accordance with the present invention. As illustrated, multitiered pillow 40 is composed of a shell 42 and pillow packing material 44. Shell 42 defines the shape of multitiered pillow 40 and is composed of panels 46*a–c*. Panels 46*a–c* also define segregated compartments 48*a–b* which define the multitiers of pillow 40, in this case lower tier 50, upper tier 52 and lower tier 54.

As illustrated, compartment 48*a* is associated only with upper tier 52, thereby preventing pillow packing material 44 adjacent upper tier 52 from migrating to either of lower tiers 50 and 54. As illustrated, lower tiers 50 and 54 are especially suitable for supporting the head and neck of a person P and P' when in the prostrate position. Also, upper tier 52 is especially suitable for supporting the head and neck of a person (not shown) when laying sideways with the head and neck resting on upper tier 52.

Figure 5:
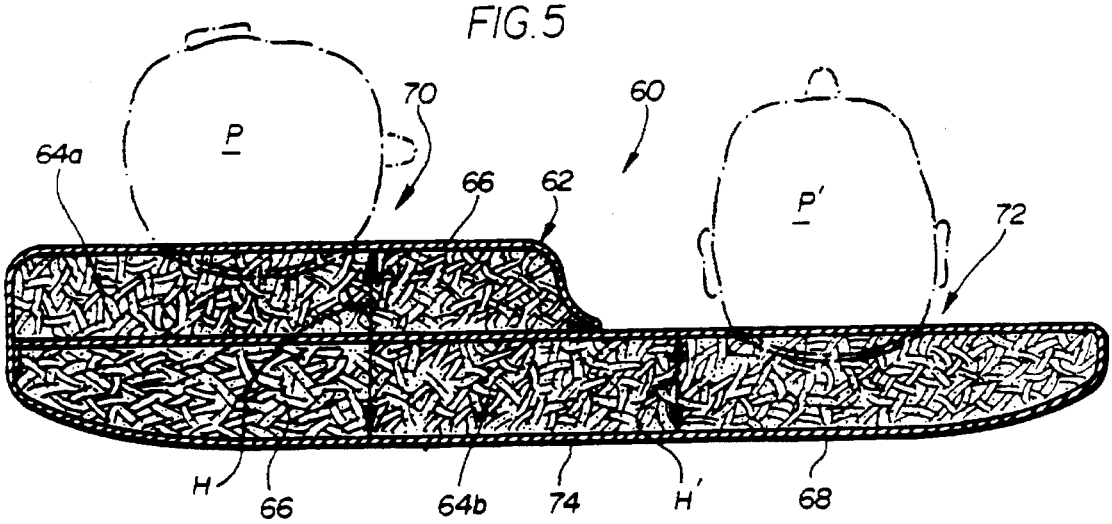
FIG. 5 illustrates a cross-sectional view of another embodiment of the pillow in accordance with the present invention.

Referring to FIG. 5, there is illustrated another embodiment in accordance with the invention. A multitiered pillow 60 is provided. Multitiered pillow 60 is composed of a shell 62 that defines segregated compartments 64*a–b* that contain pillow packing material 66. Shell 62 is composed of a single piece of fabric 68 which is folded over onto itself and spaced apart as illustrated in FIG. 5 to form compartments 64*a* and 64*b*.

Shell 62 thereby defines, in combination with packing material 66 an upper tier 70 and a lower tier 72. Upper tier 70 is especially suitable for supporting the head and neck of a person P laying on his side while lower tier 72 is especially suitable for supporting the head and neck portions of a person P' laying on his back.

Preferably, the uncompressed height H of upper tier 70 as measured from the bottom 74 of pillow 60 is at least about twice the uncompressed height H' of lower tier 72 also as measured from bottom 74 of pillow 60. Generally, the height of the upper tier may be two to three times or more the uncompressed height of the lower tier in accordance with the invention.

Figure 7:
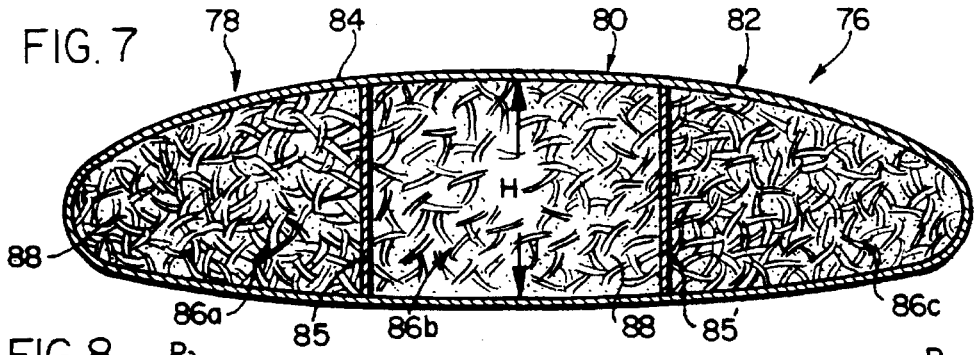
FIG. 7 illustrates a cross-sectional elevation view of a pillow in accordance with the invention having three tiers, each of a predetermined effective height.
Figure 8:
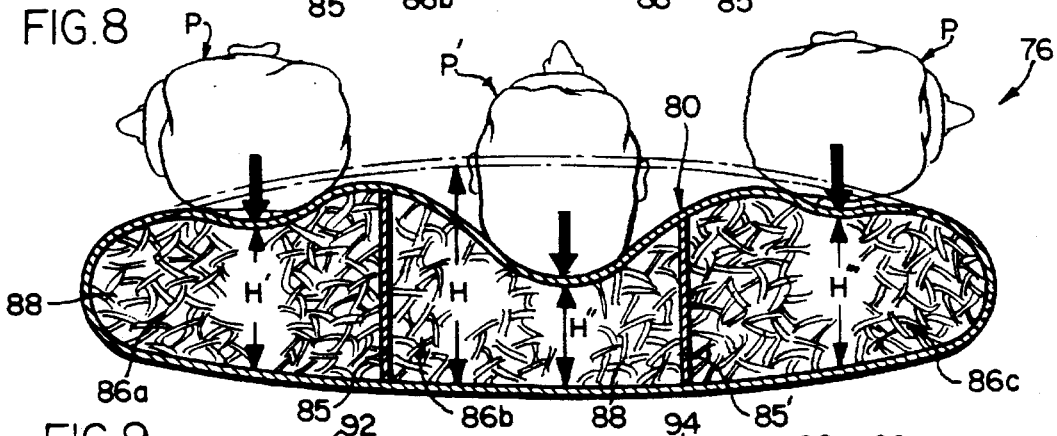
FIG. 8 illustrates the pillow of FIG. 7 showing the effective heights of the different tiers.

Referring to FIG. 7, there is illustrated another embodiment in accordance with the invention. A multitiered pillow 76 is provided having three effective tiers 78, 80 and 82. Multitiered pillow 76 is composed of a shell 84, having walls 85 and 85', that define segregated compartments 86*a–c* that contain pillow packing material 88. Shell 84 is composed of fabric material configured to provide the desired shape for pillow 76 and the separate compartments 86*a–c*. Compartments 86*a* and 86*c* are packed with pillow packing material 88 to a substantially greater degree than compartment 86*b*. Consequently, tiers 78 and 82, when subjected to the weight of a person's head laying on the pillow, compress to a lesser degree than when the person's head is resting on tier 80, as shown in FIG. 8. The weight of a person's head, as shown in FIG. 8 compresses tier 78 such that a height H is achieved which is approximately twice the height, H', of tier 80. Similarly, the height H" of tier 82 when compressed is about twice the height of tier 80 when compressed by the weight of a typical person's head resting thereon. By varying the amount or type of pillow packing material, the desired effective height of each tier (the height of the tier when loaded by a normal person's head) can be achieved. As illustrated in FIG. 8, the effective height of tiers 78 and 82 are the same or substantially equal. If desired, each of tiers 78, 80 and 82 could have a different effective height as desired so that, for example, height H would be the greatest, height H' would be the lowest and height H" would be an intermediate height. As shown in FIG. 8, height H' is a suitable height for a person's head when the person P' is laying on his back, and upper tiers 78 and 82 are of a suitable effective height when a person P is laying on his side.

Figure 12:
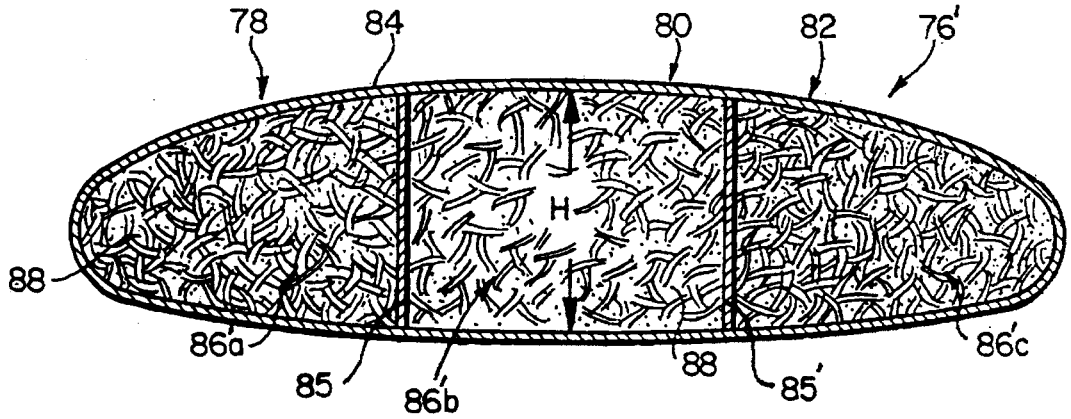
FIG. 12 illustrates a cross-sectional view of another pillow in accordance with the present invention.
Figure 13:
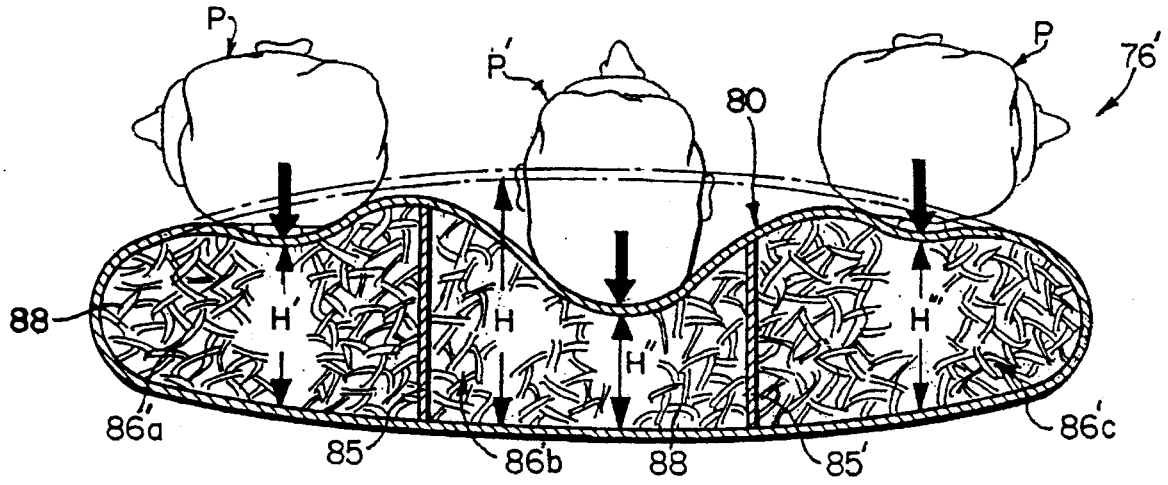
FIG. 13 illustrates the pillow of FIG. 12 showing the effective heights of the different tiers.

Pillow 76' as illustrated in FIG. 12 and 13 is constructed as an inflatable pillow such that compartments 86'*a–c* can be inflated to a desired air pressure in place of or in addition to the presence of some material 88. By adjusting the pressure in compartments 86'*a* and 86'*c* to be greater than the pressure of compartment 86'*b*, the desired compressed tier height H', H" and H'" can be achieved.

Figure 9:
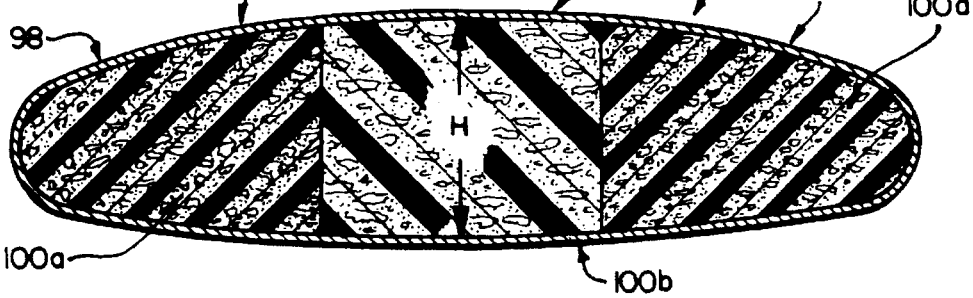
FIG. 9 illustrates a cross-sectional elevation view of another pillow in accordance with the present invention having a central tier of a lower effective height and adjacent outer tiers of higher effective height.
Figure 11:
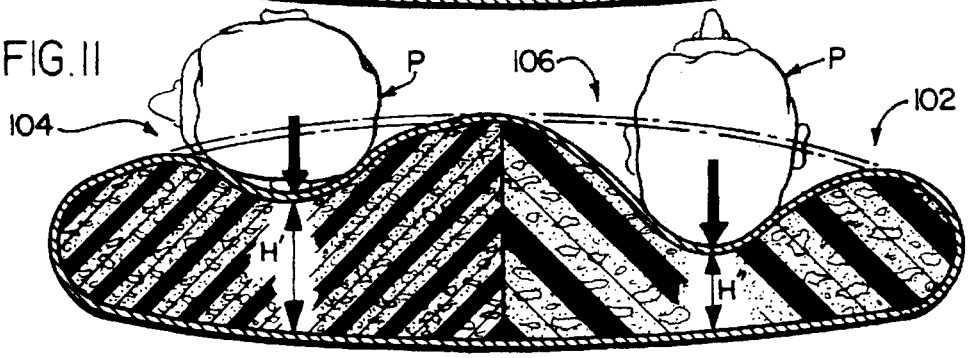
FIG. 11 illustrates the pillow of FIG. 10 showing the effective heights of the tiers.

Referring to FIG. 9, there is illustrated another embodiment in accordance with the invention. A multitiered pillow 90 is provided that has effective tiers 92, 94 and 96, each tier 92–96 having an uncompressed height H such that the height of uncompressed pillow 90 is essentially uniform. Pillow 90 is composed of a shell 98 which may be constructed of a suitable fabric. The interior of pillow 90 is composed of foam rubber material 100*a* and 100*b*. Foam rubber material 100*a* compresses to a lesser degree than foam rubber material 100*b* when subjected to a load such as a person's head laying on pillow 90, as illustrated in FIG. 11. Thus, tiers 92 and 96 provide a compressed height H' and H'" shown with respect to multitiered pillow 76 of FIG. 8 for effective tiers 92 and 96 and a height H" similar to that shown with respect to pillow 76 of FIG. 8 for tier 94. If desired, the foam rubber 100*a* and 100*b* which defines effective tiers 92, 94 and 96, can each be composed of a separate mass that may be adhesively or otherwise secured together to form a unitary mass that defines the body of multitiered pillow 90.

Figure 10:
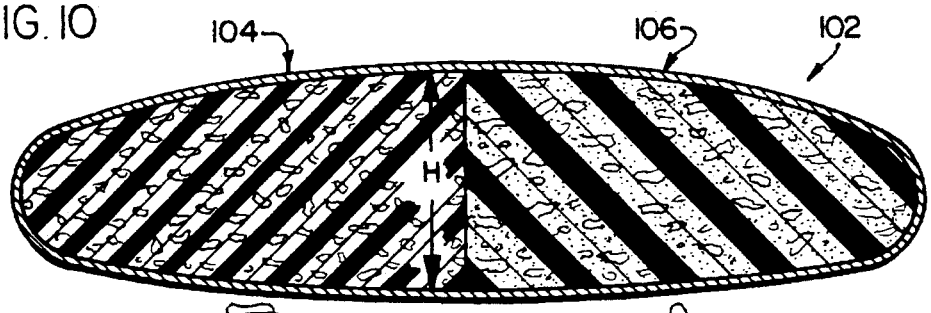
FIG. 10 illustrates a cross-sectional view of another pillow in accordance with the present invention having one tier of a lower effective height and an adjacent tier of a higher effective height.

Referring to FIGS. 10 and 11, there is illustrated another embodiment in accordance with the invention. A multitiered pillow 102 is provided having effective tiers 104 and 106. Tier 104 has an effective or compressed height H' when a typical person's head P is resting on the pillow that is approximately two to three times the compressed height H" of tier 106 when compressed by the weight of a person's head P' resting on that portion of pillow 102.

While the invention has been described with respect to certain preferred embodiments, it is to be understood that the invention is capable of numerous rearrangements, substitutions and changes that are within the scope of the following claims and it is intended that the invention cover all such changes, rearrangements and modifications.

I claim:

1. A multitiered pillow comprising an elongated compressible pillow body having a width, a length and a depth of the pillow body defining a pillow top and a pillow bottom and at least first and second tiers, each tier transversely extending along a different longitudinal region of the pillow, the pillow body length being greater than the pillow body width, the first and second tiers each having an uncompressed height that is about the same and the second tier having an effective compressed height from the pillow bottom of from about two to about three times the effective compressed height of the first tier from the pillow bottom, the effective compressed height of the first tier being suitable for supporting a person's head while in a prostrate position and the effective compressed height of the second tier being suitable for supporting a person's head while laying sideways.

2. The multitiered pillow of claim 1 wherein the elongated pillow body is composed of a unitary mass of compressible material having regions of different compressibility corresponding to the first and second tiers.

3. The multitiered pillow of claim 2 wherein the compressible material is foam rubber.

4. The multitiered pillow of claim 1 wherein the longitudinal cross section of the pillow body is U-shaped and includes two upper tiers separated by a lower tier.

5. The multitiered pillow of claim 1 wherein the pillow body is formed in a plurality of compartments, each compartment being segregated from the other compartments and containing a pillow packing material.

6. The multitiered pillow of claim 5 wherein the compartments include a central lower compartment defining the lower tier and at least one other compartment defining the upper tier.

7. The multitiered pillow of claim 1 wherein said pillow body is composed of a plurality of segregated compartments for containing pillow packing material, each compartment associated with only an upper tier or a lower tier.

8. The multitiered pillow of claim 1 wherein the pillow body defines a central upper tier having first and second longitudinal sides and adjacent lower tiers on either longitudinal side of the central upper tier.

9. The multitiered pillow of claim 1 wherein the pillow body includes first and second longitudinal sides and defines an upper tier on one longitudinal side of the pillow body and a lower tier on the other longitudinal side of the pillow body.

10. The multitiered pillow of claim 1 wherein the pillow contains at least two inflatable compartments, each compartment corresponding to one of said tiers and being inflated to a desired air pressure to provide said effective compressed height.

11. A multitiered pillow comprising an elongated compressible pillow body having a width and a depth of the pillow body defining a pillow top and a pillow bottom, the pillow body including first and second longitudinal sides and defines a first tier on one longitudinal side of the pillow body and a second tier on the other longitudinal side of the pillow body, the first and second tiers each having an uncompressed height that is about the same in the second tier having an effective compressed height from the pillow bottom of about twice the effective compressed height of the first tier from the pillow bottom, the effective compressed height of the first tier being suitable for supporting a person's head while in a prostrate position and the effective compressed height of the second tier being suitable for supporting a person's head while laying sideways.

12. A multitiered pillow comprising an elongated compressible pillow body having a width and a depth of the pillow body and defining a pillow top and a pillow bottom and at least first and second tiers, the first and second tiers each having an uncompressed height that is about the same and the second tier having an effective compressed height from the pillow bottom of about twice the effective compressed height of the first tier from the pillow bottom, the effective compressed height of the first tier being suitable for supporting a person's head while in a prostrate position and the effective compressed height of the second tier being suitable for supporting a person's head while laying sideways, wherein the pillow contains at least two inflatable compartments, each compartment corresponding to one of said tiers and being inflated to a desired air pressure to provide said effective compressed height.

* * * * *